United States Patent [19]

Kusaka

[11] Patent Number: 4,805,893

[45] Date of Patent: Feb. 21, 1989

[54] ABNORMAL-PAPER SENSING APPARATUS IN A PRINTING MACHINE

[75] Inventor: Akehiro Kusaka, Higashikatsushika, Japan

[73] Assignee: Komori Printing Machinery Co., Ltd., Tokyo, Japan

[21] Appl. No.: 125,484

[22] Filed: Nov. 25, 1987

[51] Int. Cl.[4] ..... B65H 7/14; B65H 7/06; B65H 7/08; B65H 7/10

[52] U.S. Cl. ..... 271/258; 250/561; 250/562; 101/247; 101/408; 271/265

[58] Field of Search ..... 271/227, 259, 261, 244, 271/265, 263, 228, 261 X, 190, 258; 101/284, 408, 409, 410, 232, 247; 250/561, 562

[56] References Cited

U.S. PATENT DOCUMENTS 3,684,890 8/1972 Hayne et al. ..... 271/261
3,829,702 8/1974 Eriksson ..... 271/227

FOREIGN PATENT DOCUMENTS 1196351 11/1985 Canada ..... 271/227
0095647 12/1983 European Pat. Off. ..... 271/227

*Primary Examiner*—Edgar S. Burr
*Assistant Examiner*—Kimberly L. Asher
*Attorney, Agent, or Firm*—Charles E. Pfund

[57] ABSTRACT

An abnormal-paper sensing apparatus in a printing machine which senses the presence of a front folded corner of a sheet of printing paper. The sheet of paper hits against front lays provided at a front end of an insertion guide plate and stops. The insertion guide plate has a pair of recesses provided in a front end portion thereof so as to extend thereacross at positions where the recesses can face the front corners of the sheet of paper which passes over the recesses. The recess have a triangular cross section with a longer side positioned on the side of the front end of the insertion guide plate and with a shorter side positioned on the side of the rear end of the insertion guide plate. When the sheet of paper hits against front lays provided at the front end of the insertion guide plate and stops, and if the sheet of paper has a folded angle at its front end, the corresponding recess is exposed and reflects the projected light diffusively, so that the sensors do not receive a quantity of reflected light enough to continue paper feeding.

8 Claims, 2 Drawing Sheets

ABNORMAL-PAPER SENSING APPARATUS IN A PRINTING MACHINE

BACKGROUND OF THE INVENTION

This invention relates to printing machines and more particularly to an abnormal-paper sensing apparatus in the printing machine which senses a folded corner of a sheet of printing paper which hits against front stays provided at a front end of an insertion guide plate and stops thereat in response to the disappearance of reflected light from the folded corner of the sheet of paper.

In a sheet-fed printing machine, sheets of printing paper stacked on a stacker of a paper feeder are drawn and fed one by one by a sucker, starting with the top sheet, to a feeder board and then delivered onto an insertion guide plate with the aid of a carrier tape and feed rolls. The sheet of paper then hits against front stays provided at a front end of the insertion guide plate and stops thereat with it being adjusted with reference to the vertical by the front stays and also with respect to right and left by a transverse needle device. The sheet of paper which has hit against and stopped is then captured and carried by a pawl of a swing device and then is printed while it is being carried with it being captured by a thicker pawl.

Sheets of paper are required to be fed one by one to the printing machine without being bent or folded. Therefore, when undesirable feeding such as feeding of a sheet of paper having a folded corner of double-sheet feeding has occurred, this is sensed and capture by the pawls and paper-feeding onto the insertion guide plate are stopped. An abnormal sheet of paper of this type is folded at its front right and/or left corner into a triangle. In order to sense this corner folding, reflection type sensors are conventionally provided several millimeters before the front stays above the sheet of paper to sense the presence of reflected light from the sheet of paper which hits against the front stays and stops to thereby determine that there is corner folding in the sheet due to the fact that no reflected light is received. When a sheet of paper having a different size is used, the sensor is moved correspondingly.

In such corner folding sensor, however, the insertion guide plate itself will reflect light which is projected to its exposed portions. Therefore, the sensor is likely to erroneously determine that there is no corner folding although there is actually corner folding, and thereby continue paper feeding. In order to avoid this, through holes are provided in the insertion guide plate so as to cause the projected light to pass through the hole without reflecting the projected light when there is corresponding corner folding. However, in order to cope with a different paper size or alter the sensing position, the holes must be elongated in the form of slots, so that a sheet of paper sliding on the insertion guide plate may be hooked at its corner into the elongated slot and bent to thereby operate the sensor, thus stopping feeding of the sheet of paper. Provision of such an elongated hole would weaken the strength of the end portion of the insertion guide plate.

SUMMARY OF THE INVENTION

Therefore, it is the object of the present invention to provide an improved abnormal-paper sensing apparatus in a printing machine.

In order to solve these problems, according to this invention, for example, the insertion guide plate has a pair of recesses provided in a front end portion thereof so as to extend there-across at positions where the recesses can face front corners of the sheet of paper which passes over the recesses, the recess having a triangular cross section with a longer side positioned on the side of the front end of the insertion guide plate and with a shorter side positioned on the side of the rear end of the insertion guide plate.

When a sheet of paper fed onto the insertion guide plate normally hits against the front stays and stops thereat, the sensor receives light emitted by the sensor itself and reflected by the sheet of paper, so that normal paper feeding continues. When corner folding occurs and the sheet of paper is stopped by the front stays, the light projected by the sensor reaches the exposed slant bottom of the recess and reflected diffusively because the exposed bottom is slanting. Thus the sensor does not receive the reflected light. As a result, a signal is generated to stop the paper feeding.

BRIEF DESCRIPTION OF THE DRAWINGS

FIG. 1 is a plan view of one left half of a insertion guide plate;

FIG. 2 is an enlarged plan view of that portion of the insertion guide plate which includes a recess;

FIG. 3 is a cross-section view taken along the line A—A of FIG. 2; and

FIG. 4 is a cross-section of a sensor and its vicinity.

DETAILED DESCRIPTION OF THE PREFERRED EMBODIMENT

Figure 1:
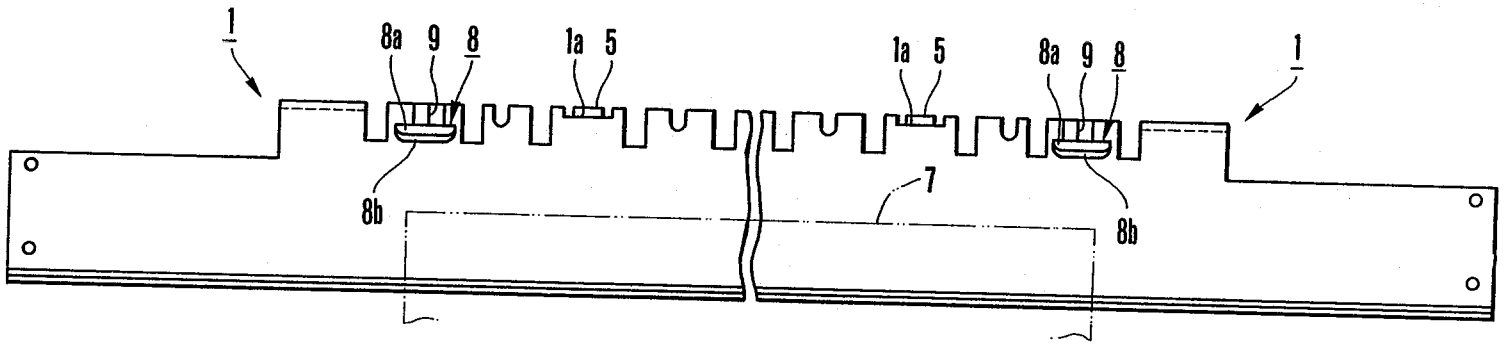
FIGS. 1 to 4 show an embodiment of an abnormal-paper sensing apparatus in a printing machine according to this invention.
Figure 2:
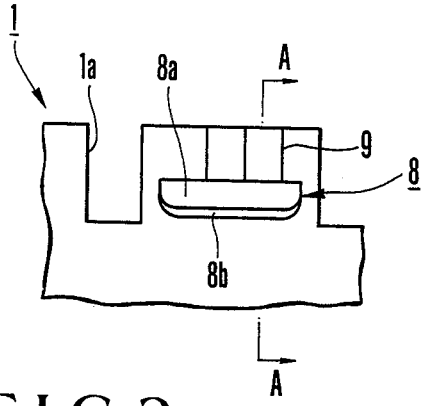
Figure 3:
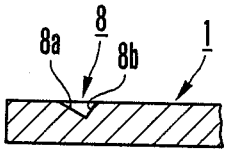
Figure 4:
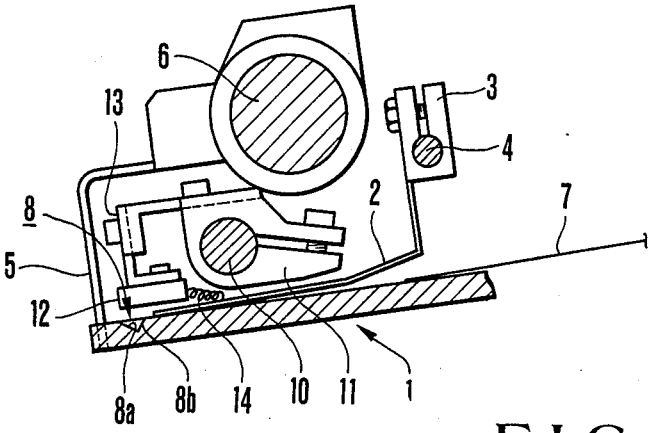

In FIGS. 1 to 4, an abnormal-paper sensing apparatus according this invention includes an elongated strip-like insertion guide plate or feedboard 1 which extends across the feeding direction of the printing machine. It is also supported slightly slanting between a paper feeder (not shown) and a printing unit (not shown), as shown in FIG. 4. A plurality of leaf springs 2 are disposed parallel to each other across the machine and supported by supports 4 above the front end of the feedboard 1 by means of brackets 3. The front ends of the leaf springs 2 abut slidably on an upper surface of the front end of the feedboard 1. A plurality of front stays 5 are supported in parallel with each other across the printing machine by a shaft 6 supported above the front end of the feedboard 1. The front stays 5 are received in corresponding grooves 1a provided at the front end of the feedboard 1 whereby a reciprocating rotation of the shaft 6 through a predetermined angle at a predetermined timing causes the front stays to descend and rise vertically relative to the feedboard 1 so that they are withdrawn therefrom, as shown. The sheet of paper 7 fed onto the feedboard 1 through a feeder board (not shown) from a paper feeder (not shown) is decelerated by the leaf springs 2 and stops by engagement with the front stays 5.

A pair of right and left transeversely-disposed recesses 8—8 are provided between right and left grooves *1a-1a* several millimeters 6 rearwardly of the front end of the feedboard 1. Each recess 8 is in the form of a rectangle extending transeversely of the feedboard 1 and is of right-angled triangle cross section having a longer side 8a positioned on the side of the front end of the feedboard 1 and a shorter side 8*b* positioned on the side of the rear end of the feedboard 1. The inner surface of each recess 8 is coated with a black material. These recesses 8 are positioned and sized such that the end edge of a sheet of printing paper having any width between the maximum and minimum ones may pass over those recesses. Reference numeral 9 denotes a notched line showing one of several standard sizes of paper. A pair of clamps 11 are split-tightened in correspondence to the recesses 8 onto stays 10 supported above the front end of the feedboard 1. Each clamp 11 has fixed thereto by means of a holder 13 a reflection-type sensor 12 opposite to the corresponding recess 8. The sensor 12 is of the type which emits light and receives the light reflected by an object. In this embodiment, when the sensor receives no reflected light, it generates a signal which is delivered via a lead 14 to a controller (not shown) to thereby stop the paper feeding. Namely, when a sheet of paper 7 covers the recesses 8—8, there exists reflected light, so that no signal is generated. The arrangement is such that when a sheet of paper 7 is folded at one of its front corners, the corresponding recess 8 is exposed, so that the projected light is reflected diffusively by the bottom surface of the recess 8—8. Thus, the diffused light is not received by the sensor 12, so that the sensor 12 generates a signal.

In operation, when the sheet of paper 7 fed from the feed device via the feeder board onto the feedboard 1 hits against the front stays 5 and stops thereat, the sheet of paper 7 normally shields the recesses 8—8, so that the light projected by the sensors 12 is reflected by the sheet of paper 7. Thus, the reflected light arrives at the sensors 12, so that the sensors 12 generate no signal and paper feeding continues. Namely, when the sheet of paper 7 abuts the front stays and stops thereat, the shaft 6 is rotated clockwise in FIG. 4, the front stays 5 move away from the feedboard 1 and at the same time a pawl of a swing device (not shown) swings diagonally upwardly, captures the sheet of paper 7 and moves it to the printing unit.

When a sheet of paper having its corner folded is fed onto the feedboard 1, into engagement with the front stays 5 and stops thereat, the folded corner of the sheet of paper does not shield so that the corresponding recess 8 is exposed. In this case, each recess 8 has a slant inner surface asymmetrical around a transverse plane therein and coated with a black material, so that the light projected from the sensors 12 is reflected diffusively by the recess bottom surface. Therefore, the reflected light does not arrive at the sensors 12, so that the sensors 12 produce a signal to stop the paper feeding. Thus the abnormal-sheet of paper with the folded corner is removed and printing is then resumed.

When a sheet of paper having a different size is used, the clamps 11 are loosened and the sensor 12 are moved so as to cope with the different paper size.

As will be described from the aforementioned description, according to this invention, the insertion guide plate has a pair of recesses provided in a front end portion thereof so as to extend thereacross at positions where the recesses can face front corners of the sheet of paper which passes over the recesses, the recess having a triangular cross section with a longer side positioned on the side of the front end of the insertion guide plate and with a shorter side positioned on the side of the rear end of the insertion guide plate. When a sheet of paper with a folded corner hits against the front lays and stops thereat, the corresponding recess is exposed, the light projected from the sensor to the exposed recess is reflected diffusively by the asymmetrically slant notch-like bottom surface of the recess. In addition, even when a sheet of paper having a different size is used, which has a folded corner, it does not cover the corresponding recess, so that the reflected light does not reach the sensor. Therefore, corner folding is reliably sensed irrespective of the paper size so as to stop the paper feeding to thereby improve the sensing accuracy. The front-side portion of the recess bottom is gently inclined at a low angle, so that a corner of a normal sheet of paper is not trapped, thereby reducing a quantity of wasted paper. In addition, the recesses do not extend through the insertion guide plate, so that it has a strength greater than the conventional one. If the recess bottom is coated with a black material, sensing will further be improved.

What is claimed is:

1. An abnormal-paper sensing apparatus in a printing machine comprising a stationary insertion guide plate, front stays at the forward edge of the guide plate for aligning the forward edge of the paper on the guide plate, means for feeding the paper over the guide plate into engagement with said front stays and light-projecting sensors supported above the guide plate for sensing light reflected from a normal sheet, and the absence of reflected light due to the presence of a front folded corner at the forward edge of a sheet of paper engaged with the front stays, said guide plate having a pair of transversely-spaced recesses adjacent the front edge below the sensors, said recesses having a cross section such that in the event that a corner of the sheet is folded light from at least one of said light-projecting sensors will be diffused away by means of the recess cross section and means operable in the event that light fails to be reflected to abort operation of the means for feeding the paper.

2. Apparatus according to claim 1 wherein the recesses have a cross section defined by forwardly-extending long sides and a rearwardly-extending short sides.

3. Apparatus according to claim 1 wherein the recesses have a cross section of right triangular configuration.

4. Apparatus according to claim 1 wherein a black coating is applied to the recesses for absorbing light.

5. In an abnormal-paper sensing apparatus in a printing machine having a stationary insertion guide plate for receiving and inserting a sheet of paper into a printing unit, a plurality of front stays provided at the front end of said insertion guide plate for adjusting the position of a sheet of paper thereon and paper feeding means for advancing the forward end of the sheet into engagement with said stays, said insertion guide plate having a pair of recesses along either side thereof such that they face the corresponding corners of a sheet engaged with the stays, said recesses having a structure for creating diffused reflection and a pair of sensors above the guide plate for projecting light such that when a sheet of paper having a front folded corner passes over one of the recesses, the light projected by the sensor above the folded corner is reflected diffusely by said recesses and not received by said sensors, and means responsive to the absence of reflected light at each of said sensors to stop the paper feeding means.

6. An abnormal-paper sensing apparatus in a printing machine as set forth in claim 5, wherein each recess has a triangular cross section.

7. An abnormal-paper sensing apparatus in a printing machine as set forth in claim 6, wherein the inner surface of said recesses is coated with a black material for causing absorption of reflected light.

8. An abnormal-paper sensing apparatus in a printing machine according to claim 5, wherein said recesses have a transverse length long enough to permit sensing a sheet of paper of abnormal width.

* * * * *